US011174722B2

(12) United States Patent
Wang et al.

(10) Patent No.: US 11,174,722 B2
(45) Date of Patent: Nov. 16, 2021

(54) INVERSION CALCULATION METHOD OF COAL-BED GAS PARAMETERS OF FAST TEST WHILE-DRILLING

(71) Applicants: China University of Mining and Technology, Jiangsu (CN); XUZHOU FUAN TECHNOLOGY CO., LTD., Xuzhou (CN)

(72) Inventors: Enyuan Wang, Jiangsu (CN); Hao Wang, Jiangsu (CN); Jianchun Ou, Jiangsu (CN); Rongxi Shen, Jiangsu (CN); Xiyuan Wang, Jiangsu (CN); Baolin Li, Jiangsu (CN); Zhonghui Li, Jiangsu (CN); Xiaofei Liu, Jiangsu (CN)

(73) Assignees: China University of Mining and Technology, Jiangsu (CN); XUZHOU FUAN TECHNOLOGY CO., LTD., Xuzhou (CN)

( * ) Notice: Subject to any disclaimer, the term of this patent is extended or adjusted under 35 U.S.C. 154(b) by 0 days.

(21) Appl. No.: 17/043,728

(22) PCT Filed: Oct. 12, 2019

(86) PCT No.: PCT/CN2019/110750
§ 371 (c)(1),
(2) Date: Sep. 30, 2020

(87) PCT Pub. No.: WO2020/258589
PCT Pub. Date: Dec. 30, 2020

(65) Prior Publication Data

US 2021/0262341 A1 Aug. 26, 2021

(30) Foreign Application Priority Data

Jun. 24, 2019 (CN) ..... 201910551854.1

(51) Int. Cl.
*E21B 47/06* (2012.01)
*G06Q 50/02* (2012.01)
*E21B 47/01* (2012.01)

(52) U.S. Cl.
CPC ..... *E21B 47/06* (2013.01); *E21B 47/01* (2013.01); *G06Q 50/02* (2013.01)

(58) Field of Classification Search
CPC ..... E21B 47/06; E21B 47/01; G06Q 50/02
(Continued)

(56) References Cited

U.S. PATENT DOCUMENTS 10,947,842 B2 * 3/2021 Wang ..... G01V 1/52
2003/0196484 A1 10/2003 Bowler, III et al.
2012/0227960 A1 * 9/2012 Pope ..... E21B 49/087 166/250.01

FOREIGN PATENT DOCUMENTS

CN 101975075 2/2011
CN 106401557 2/2017
(Continued)

OTHER PUBLICATIONS

English translation of Cai (CN109917101) acessed from patentscope.wipo.com Aug. 24, 2021.*
(Continued)

*Primary Examiner* — Nimeshkumar D Patel
*Assistant Examiner* — Jean F Morello
(74) *Attorney, Agent, or Firm* — JCIPRNET

(57) ABSTRACT

The present invention provides an inversion calculation method of coal-bed gas parameters of fast test while-drilling. The technical solution is that an inversion calculation method of coal-bed gas parameters of fast test while-drilling includes: during drilling in a coal bed, testing a gas flow and a gas concentration of an orifice in real time while-drilling, calculating drilling gas discharge amounts of the orifice,
(Continued)

inversely calculating a coal-bed gas pressure at a drill bit based on borehole and coal-bed permeability parameters, and calculating a coal-bed gas content according to a gas content and gas pressure relational expression. The present invention has the beneficial effects that the present invention does not occupy the drilling and drill rod replacement time, is accurate, convenient, real-time and fast, and can test and calculate the coal-bed gas parameters of each section along the whole borehole length.

6 Claims, 3 Drawing Sheets

(58) Field of Classification Search
USPC ..... 73/152.02
See application file for complete search history.

(56) References Cited

FOREIGN PATENT DOCUMENTS

| | | | |
|---|---|---|---|
| CN | 106680451 | | 5/2017 |
| CN | 107448188 | | 12/2017 |
| CN | 107476822 | | 12/2017 |
| CN | 107807412 | | 3/2018 |
| CN | 109403865 | | 3/2019 |
| CN | 109709297 | | 5/2019 |
| CN | 109917101 A | * | 6/2019 |
| SU | 1149025 | | 4/1985 |

OTHER PUBLICATIONS

"International Search Report (Form PCT/ISA/210) of PCT/CN2019/110750," dated Mar. 25, 2020, pp. 1-5.

* cited by examiner

INVERSION CALCULATION METHOD OF COAL-BED GAS PARAMETERS OF FAST TEST WHILE-DRILLING

CROSS-REFERENCE TO RELATED APPLICATION

This application is a 371 of international application of PCT application serial no. PCT/CN2019/110750, filed on Oct. 12, 2019, which claims the priority benefit of China application no. 201910551854.1, filed on Jun. 24, 2019. The entirety of each of the above mentioned patent applications is hereby incorporated by reference herein and made a part of this specification.

FIELD OF THE INVENTION

The present invention relates to the technical field of coal mine geology and safety, and more particularly, to an inversion calculation method of coal-bed gas parameters of fast test while-drilling.

DESCRIPTION OF RELATED ART

Coal-bed gas parameters are main basis of coal-bed gas resource quantity assessment, coal-bed gas development, coal-bed gas occurrence regularity analysis, coal-bed outburst risk identification, coal-bed outburst risk prediction, coal-bed gas resource quantity calculation, coal-bed gas extraction design, coal and gas outburst prevention and treatment, gas extraction and outburst elimination effect evaluation, and the like. If the number of measurement points is larger, the reflection of actual distribution and inversion is more accurate. At present, the work, such as the coal-bed outburst risk identification and detection, regional prediction, and inspection of regional anti-outburst measures, is mainly carried out by testing and analyzing primary indicators such as a coal-bed gas pressure and a gas content. The parameters such as the coal-bed gas content are mainly tested by sampling. The coal-bed gas pressure is mainly obtained by a hole sealing balance test method or by inversion calculation based on the coal-bed gas content. At present, a more accurate fixed-point sampling measurement method for testing the coal-bed gas content is more complicated in sampling. Factors such as a back-drilling sampling process, a sampling duration, a sampling manner, the representativeness of a sampling location and the inversion calculation of an initial loss amount have great influence on the accuracy of a measured value of the coal-bed gas content. When a borehole is relatively long or deep, it is even more impossible to achieve this method. At present, a very common drilling-based cutting removal method is used to fast test the coal-bed gas content, but it has worse sampling point-fixing performance, lower accuracy of the sampling duration and large test error. The inspection of the regional anti-outburst measures and the partial outburst risk of a working face are mainly tested and determined by indicators such as a drilling cutting gas desorption indicator or an initial velocity of drilling gas discharge, and the like. Drilling indicators such as the drilling cutting gas desorption indicator or the initial velocity of drilling gas discharge are mainly tested after a drill withdraws from a shallow hole on the working face. These methods all have the shortcoming of a very small number of test points, and are low in reflection accuracy of coal-bed gas and outburst risk distribution, and maximum values are easily omitted. In recent years, a borehole continuous-flow method that is being researched has directly predicted or determined the coal-bed gas outburst risk based on a gas flow of an orifice. A drilling cutting method is used to seal the orifice. This hole sealing method affects cutting removal, has a relatively large error in the flow test, and a relatively large instantaneous change in the gas discharge flow, is difficult to determine the critical value for determining an outburst danger, fails in achieving the inversion calculation of the coal-bed gas parameters, and is only suitable for natural drilling.

The patent application NO. 201811567326.7 entitled a test-while-drilling method and device for coal-bed gas parameters and the patent application NO. 201710945411.1 entitled a test-while-drilling method and device for coal-bed outburst risk realize the test by sealing holes near a drill bit when the drilling is stopped. Compared with the previous technology, the inventions have made a great progress, but there are problems such as high difficulty of sealing the holes, time consumption for the test, certain influence on the drilling process, and reduction of the overall drilling speed. The failure of realizing the test of the coal-bed gas parameters does not affect while-drilling, real-time and fast test and inversion calculation in drilling and drill rod replacement processes. Therefore, it is currently impossible to accurately, conveniently, and fast realize fast test of the coal-bed gas parameters while-drilling and the outburst risk of each place while-drilling in real time.

How to solve the above technical problems is the problem that the present invention faces.

SUMMARY OF THE INVENTION

Technical Problem

The present invention is directed to provide a method for fast testing coal-bed gas parameters at a drill bit position in real time while-drilling without affecting drilling and replacing a drill rod, and provide an inversion calculation method of the coal-bed gas parameters of fast test while-drilling, which solves the problems of a few of test points for the coal-bed gas parameters at present, a little of data, a failure of local real-time test while-drilling of the coal-bed gas parameters and the outburst risk, a long duration of the test of the coal-bed gas parameters and the outburst risk, a complicated test process, and a failure of comprehensively and accurately reflecting the actual distribution of the coal-bed gas and outburst risk.

In order to better achieve the above invention objective, the present invention further provides a device for fast test of coal-bed gas parameters while-drilling. The device includes a drainage system, and further includes a blowout prevention device or an orifice quick sealing device connected to an orifice of a coal-bed borehole or a coal-passing borehole, a gas parameter monitor connected to an extraction opening of the blowout prevention device or the orifice quick sealing device, and a drainage pipeline connected with the drainage system and configured to seal the orifice and meter a drilling gas discharge amount of the orifice.

Technical Solution

The present invention is achieved through the following measures. An inversion calculation method of coal-bed gas parameters of fast test while-drilling specifically includes: during drilling in a coal bed, testing a gas flow and a gas concentration of an orifice in real time while-drilling, calculating a real-time drilling gas discharge amount and an average drilling gas discharge amount of the orifice, inversely calculating a coal-bed gas pressure at a drill bit based on borehole and coal-bed permeability parameters, and calculating a coal-bed gas content according to a gas content and gas pressure relational expression.

As a further optimization scheme of the inversion calculation method of coal-bed gas parameters of fast test while-drilling of the present invention, the method specifically includes the following steps:

a. during drilling of a coal-bed borehole or a coal-passing borehole, mounting a blowout prevention device or an orifice quick sealing device at an orifice section, and connecting a gas parameter monitor and a drainage pipeline connected with a drainage system to an extraction opening of the blowout prevention device or the orifice quick sealing device;

b. connecting the drill bit to a drill rod, and starting to carry out drilling after the drill bit passes through the blowout prevention device or the orifice quick sealing device;

c. during drilling of the coal bed, recording a coal appearing time and position, and automatically recording the gas flow and the gas concentration by the gas parameter monitor, thus calculating the real-time drilling gas discharge amount and the average drilling gas discharge amount;

d. during drilling of the boreholes, automatically calculating a coal-bed gas pressure of a test section of a drilled position of the drill bit by formulated ground monitoring and analysis software according to input drilling parameters, the coal-bed permeability, and an average drilling gas flow, and calculating the coal-bed gas content according to a coal adsorption constant and environmental parameters;

e. during drilling of a main borehole and branch boreholes by a directional drilling machine, automatically calculating a coal-bed gas pressure of the test section by the formulated ground monitoring and analysis software according to the input drilling parameters, an exposure time of each coal section, the coal-bed permeability, and the average drilling gas flow, and calculating the coal-bed gas content according to the coal adsorption constant and the environmental parameters;

f. predicting the outburst risk of each section of the coal bed according to the parameters of the coal-bed gas pressure and the coal-bed gas content; and g. in the process of drilling the coal-bed borehole or after the drilling ends, stopping drilling, closing a slag outlet, automatically recording a gas flow and a gas concentration of the borehole within each time period by a comprehensive gas parameter tester, and calculating a natural gas discharge velocity of the borehole by the formulated ground monitoring and analysis software, thus calculating a penetrability coefficient and a permeability of the coal bed at the section, and correcting the calculated coal-bed gas content or pressure parameter.

As a further optimization scheme of the inversion calculation method of the coal-bed gas parameters of fast test while-drilling of the present invention, the inversion calculation method of the coal-bed gas pressure specifically includes: in the drilling process of the drilling machine, recording in real time the gas flow and the gas concentration of the orifice and the real-time drilling gas discharge amount in a borehole forming process by the comprehensive gas parameter tester at the orifice, calculating the average drilling gas discharge amount, and inverting gas feature parameters of different positions of the coal bed according to the average drilling gas discharge amount. The total amount of gas drained by the gas drainage system at the orifice is composed of three portions, including a gas amount released from a borehole wall newly formed in the coal-bed drilling process of the drilling machine, a gas amount released by drilling cuttings peeled off from the borehole wall, and a gas amount released from the borehole wall before a new borehole wall is formed. The coal-bed gas pressure at the drill bit in the drilling process is:

$$pi = \sqrt{\frac{Q_{total} - V_{drill\ bit}\Delta t S_{section}\gamma\int_0^{\frac{l_{rock}+l_{coal}}{v}} Q_0 e^{-B_1 t}dt - \sum_1^{n-1}\int_0^{V_{drill\ bit}\Delta t}\int_{t_{i-1}}^{t_n} q_i e^{-B_2 t}dtdl}{-\frac{k}{2\mu p_n}\int_0^{V_{drill\ bit}\Delta t}\int_{t_{i-1}}^{t_n} e^{-B_2 t}dtdl}}. \quad (3)$$

pi is the coal-bed gas pressure of a calculation point. $Q_{total}$ is the total gas discharge amount measured in a calculation section. $t_0$ is the first coal appearing time. $t_1, t_2, \ldots, t_n$ are selected time points for calculating the coal-bed gas parameters, $\Delta t = t_n - t_{n-1}$. $Q_0$ is the drilling cutting gas discharge intensity at the initial exposure moment, $m^3/t \cdot min$. $\beta_1$ is a drilling cutting gas attenuation coefficient, $min^{-1}$. v is a water flow velocity, m/s. $V_{drill}$ is a borehole drilling speed, m/s. $l_{rock}$ and $l_{coal}$ are the length of a formed rock borehole and the length of a formed coal-bed borehole, m. $S_{section}$ is a cross-sectional area of the borehole, $m^2$. $\gamma$ is a coal bulk density, $kg/m^3$. $q_i$ is a gas discharge amount on a coal wall per unit area, $m^3/m^2 \cdot min$. $\beta_2$ is a borewall gas attenuation coefficient, $min^{-1}$. k is the coal-bed permeability, $m^2$. $\mu$ is a dynamic viscosity coefficient of gas, Pa·s. $p_n$ is an absolute pressure of gas drainage Pa. x and $R_M$ are an effective influence radius around the borehole, m.

As a further optimization scheme of the inversion calculation method of the coal-bed gas parameters of fast test while-drilling of the present invention, to calculate the gas pressure of an $i^{th}$ coal hole section, it is necessary to calculate the gas pressures of the previous (i−1) coal hole sections. Since the gas pressure of each branch hole is different, $q_i$ is also different. The gas pressure of any coal hole section may be calculated according to the above formula (3), and $q_i$ is calculated according to the formula:

$$q = -\frac{k}{2\mu p_n}\frac{\partial p^2}{\partial x}. \quad (4)$$

The drilling cutting gas attenuation coefficient $\beta_1$ and the borehole wall gas attenuation coefficient $\beta_2$ may be measured by experiments and field tests.

The coal-bed gas content $X_{mi}$ may be calculated through the gas content and gas pressure relational expression according to a coal-bed gas adsorption constant and the environmental parameters.

As a further optimization scheme of the inversion calculation method of the coal-bed gas parameters of fast test while-drilling of the present invention, the gas flow and the gas concentration of the orifice of the borehole are tested in real time while-drilling. The real-time gas discharge amount of the orifice of the borehole is calculated by a comprehensive gas parameter tester and a drainage system, and then the average drilling gas discharge amount is calculated. A time interval is time corresponding to a borehole drilling distance of 2 to 5 m.

As a further optimization scheme of the inversion calculation method of the coal-bed gas parameters of fast test while-drilling of the present invention, in the step d and the step e, corresponding actually measured coal-bed permeability parameters are used for different drilling operations. When no actually measured coal-bed permeability values are present, an original coal bed may use an original coal-bed permeability value of a coal bed in this region.

Advantageous Effect

The present invention has the beneficial effects that in the present invention, the average gas discharge amount of the orifice in a certain section drilling process is tested in real time while-drilling. The coal-bed gas pressure at the drill bit is inversely calculated based on the drilling parameters, the exposure time of each coal section, and the coal-bed permeability, and the coal-bed gas content is calculated according to the coal adsorption constant and the environmental parameters, thus solving the problems of a few of test points for the coal-bed gas parameters at present, a little of data, a failure of local real-time test while-drilling of the coal-bed gas parameters and the outburst risk, a long duration of the test of the coal-bed gas parameters and the outburst risk, a complicated test process, and a failure of comprehensively and accurately reflecting the actual distribution of the coal-bed gas and outburst risk. The method has the advantages of low investment, no requirement for a special device, back-drilling and sampling, no occupation of drilling and drill rod replacement time, is accurate, convenient, real time and fast, can test and calculate the coal-bed gas parameters of each section along the whole borehole length, may be widely applied to while-drilling test of the coal-bed gas parameters, while-drilling test of the coal-bed outburst risk, gas extraction, inspection of an outburst prevention effect and the like, and is also applicable to coal-bed-passing boreholes, and the main hole and the branch holes directionally drilled in the coal bed, particularly to long-deep boreholes.

DETAILED DESCRIPTION OF THE INVENTION

Figure 1:
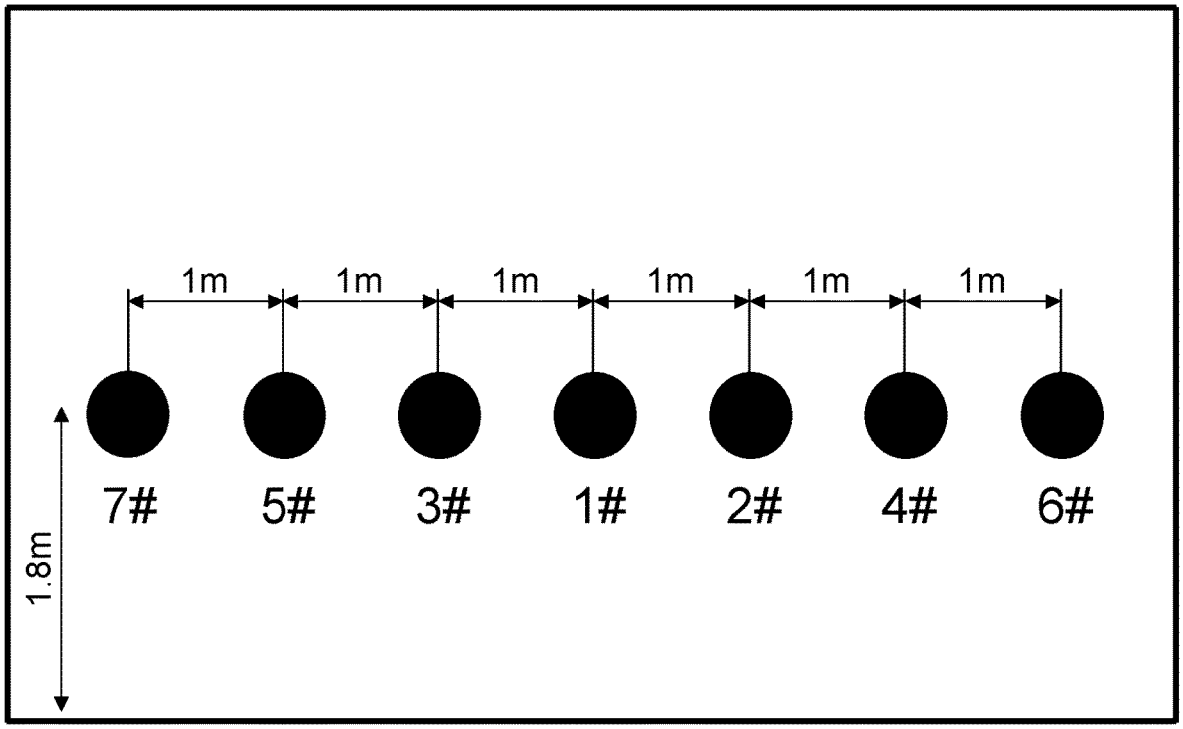
FIG. 1 is a schematic diagram of arrangement of boreholes subjected to directional drilling in an air way drilling field of a certain coal and gas outburst mine 12171 according to an embodiment of the present invention.

To clearly describe the technical characteristics of the present invention, the following describes the present invention through specific implementations.

The present invention provides an inversion calculation method of coal-bed gas parameters of fast test while-drilling, specifically including: during drilling in a coal bed, a gas flow and a gas concentration of an orifice of a borehole are tested in real time while-drilling, a real-time drilling gas discharge amount and an average drilling gas discharge amount of the orifice are calculated, a coal-bed gas pressure at a drill bit is calculated based on borehole and coal-bed permeability parameters, and a coal-bed gas content is calculated according to a gas content and gas pressure relational expression.

The method specifically includes the following steps.

a. During drilling of a coal-bed borehole or a coal-passing borehole, a blowout prevention device or an orifice quick sealing device is mounted at an orifice section, and a comprehensive gas parameter tester and a drainage pipeline connected with a drainage system are connected to an extraction opening of the blowout prevention device or the orifice quick sealing device.

b. The drill bit is connected to a drill rod, and drilling starts to be carried out after the drill bit passes through the blowout prevention device or the orifice quick sealing device.

c. During drilling of the coal bed, a coal appearing time and position are recorded, and the comprehensive gas parameter tester automatically records the gas flow and the gas concentration, thus calculating the real-time drilling gas discharge amount and the average drilling gas discharge amount.

d. During drilling of the boreholes, a coal-bed gas pressure of a test section of a drilled position of the drill bit is automatically calculated by formulated ground monitoring and analysis software according to input drilling parameters, the coal-bed permeability, and an average drilling gas flow, and the coal-bed gas content is calculated according to a coal adsorption constant and environmental parameters.

e. During drilling of a main borehole and branch boreholes by a directional drilling machine, a coal-bed gas pressure of the test section is automatically calculated by the formulated ground monitoring and analysis calculation software according to the input drilling parameters, an exposure time of each coal section of each hole, the coal-bed permeability, and the average drilling gas flow, and the coal-bed gas content is calculated according to the coal adsorption constant and the environmental parameters.

f. The outburst risk of each section of the coal bed is predicted according to the parameters of the coal-bed gas pressure and the coal-bed gas content.

g. In the process of drilling the coal-bed borehole or after the drilling ends, drilling is stopped, a slag outlet is closed, the comprehensive gas parameter tester automatically records a gas flow and a gas concentration of the borehole within each time period, and the formulated ground monitoring and analysis software calculates a natural gas discharge velocity of the borehole, thus calculating a penetrability coefficient and a permeability of the coal bed at the section, and correcting the calculated coal-bed gas content or pressure parameter.

The inversion calculation method of the coal-bed gas pressure specifically includes: in the drilling process of the drilling machine, the comprehensive gas parameter tester at the orifice records in real time the gas flow and the gas concentration of the orifice and the real-time drilling gas discharge amount in the drilling process, the average drilling gas discharge amount is calculated, and gas feature parameters of different positions of the coal bed are inverted according to the average drilling gas discharge amount. The total amount of gas drained by the gas drainage system at the orifice is composed of three portions, including a gas amount released from a borehole wall newly formed in the coal-bed drilling process of the drilling machine, a gas amount released by drilling cuttings peeled off from the borehole wall, and a gas amount released from the borehole wall before a new borehole wall is formed. The coal-bed gas pressure at the drill bit in the drilling process is:

$$pi = \sqrt{\frac{Q_{total} - V_{drill\ bit}\Delta t S_{section}\gamma \int_0^{\frac{l_{rock}+l_{coal}}{v}} Q_0 e^{-B_1 t} dt - \sum_1^{n-1} \int_0^{V_{drill\ bit}\Delta t} \int_{t_{i-1}}^{t_n} q_i e^{-B_2 t} dt dl}{-\frac{k}{2\mu p_n} \int_0^{V_{drill\ bit}\Delta t} \int_{t_{i-1}}^{t_n} e^{-B_2 t} dt dl}}. \quad (5)$$

pi is the coal-bed gas pressure of a calculation point. $Q_{total}$ is the total gas discharge amount measured in a calculation section. $t_0$ is the first coal appearing time. $t_1, t_2, \ldots, t_n$ are selected time points for calculating the coal-bed gas parameters, $\Delta t = t_n - t_{n-1}$. $Q_0$ is the drilling cutting gas discharge intensity at the initial exposure moment, $m^3/t \cdot min$. $\beta_1$ is a drilling cutting gas attenuation coefficient, $min^{-1}$. v is a water flow velocity, m/s. $V_{drillbit}$ is a borehole drilling speed, m/s. $l_{rock}$ and $l_{coal}$ are the length of a formed rock borehole and the length of a formed coal-bed borehole, m. $S_{section}$ is a cross-sectional area of the borehole, $m^2$. $\gamma$ is a coal bulk density, $kg/m^3$. $q_i$ is a gas discharge amount on a coal wall per unit area, $m^3/m^2 \cdot min$. $\beta_2$ is a borewall gas attenuation coefficient, $min^{-1}$. k is the coal-bed permeability, $m^2$. $\mu$ is a dynamic viscosity coefficient of gas, Pa·s. $p_n$ is an absolute pressure of gas drainage Pa. $R_M$ is an effective influence radius around the borehole, m.

To calculate the gas pressure of an $i^{th}$ coal hole section, it is necessary to calculate the gas pressures of the previous (i−1) coal hole sections. Since the gas pressure of each branch hole is different, $q_i$ is also different. The gas pressure of any coal hole section may be calculated according to the above formula (5), and $q_i$ is calculated according to the formula:

$$q = -\frac{k}{2\mu p_n}\frac{\partial p^2}{\partial x}. \quad (6)$$

The drilling cutting gas attenuation coefficient $\beta_1$ and the borehole wall gas attenuation coefficient $\beta_2$ may be measured by experiments and field tests.

The coal-bed gas content $X_{mi}$ may be calculated through the gas content and gas pressure relational expression according to a coal-bed gas adsorption constant and the environmental parameters.

The gas flow and the gas concentration of the orifice of the borehole are tested in real time while-drilling. The real-time gas discharge amount of the orifice of the borehole is calculated by the comprehensive gas parameter tester and the drainage system, and then the average drilling gas discharge amount is calculated. A time interval is time corresponding to a borehole drilling distance of 2 to 5 m.

The step e specifically includes: the coal-bed gas parameters are respectively calculated from a coal appearing point section by section; during drilling of the main borehole and the branch boreholes by the directional drilling machine, the ground monitoring and analysis software automatically calculates the coal-bed gas pressure of the test section according to the input drilling parameters, the exposure time of each coal section of each hole, the coal-bed permeability, and the average drilling gas discharge amount, and the coal-bed gas content is calculated according to the coal adsorption constant and the environmental parameters.

In the step d and the step e, corresponding actually measured coal-bed permeability parameters are used for different drilling operations. When no actually measured coal-bed permeability values are present, an original coal bed may use an original coal-bed permeability value of a coal bed in this region.

A specific example of the test by using the inversion calculation method of the coal-bed gas parameters of fast test while-drilling is specifically as follows.

Figure 2:
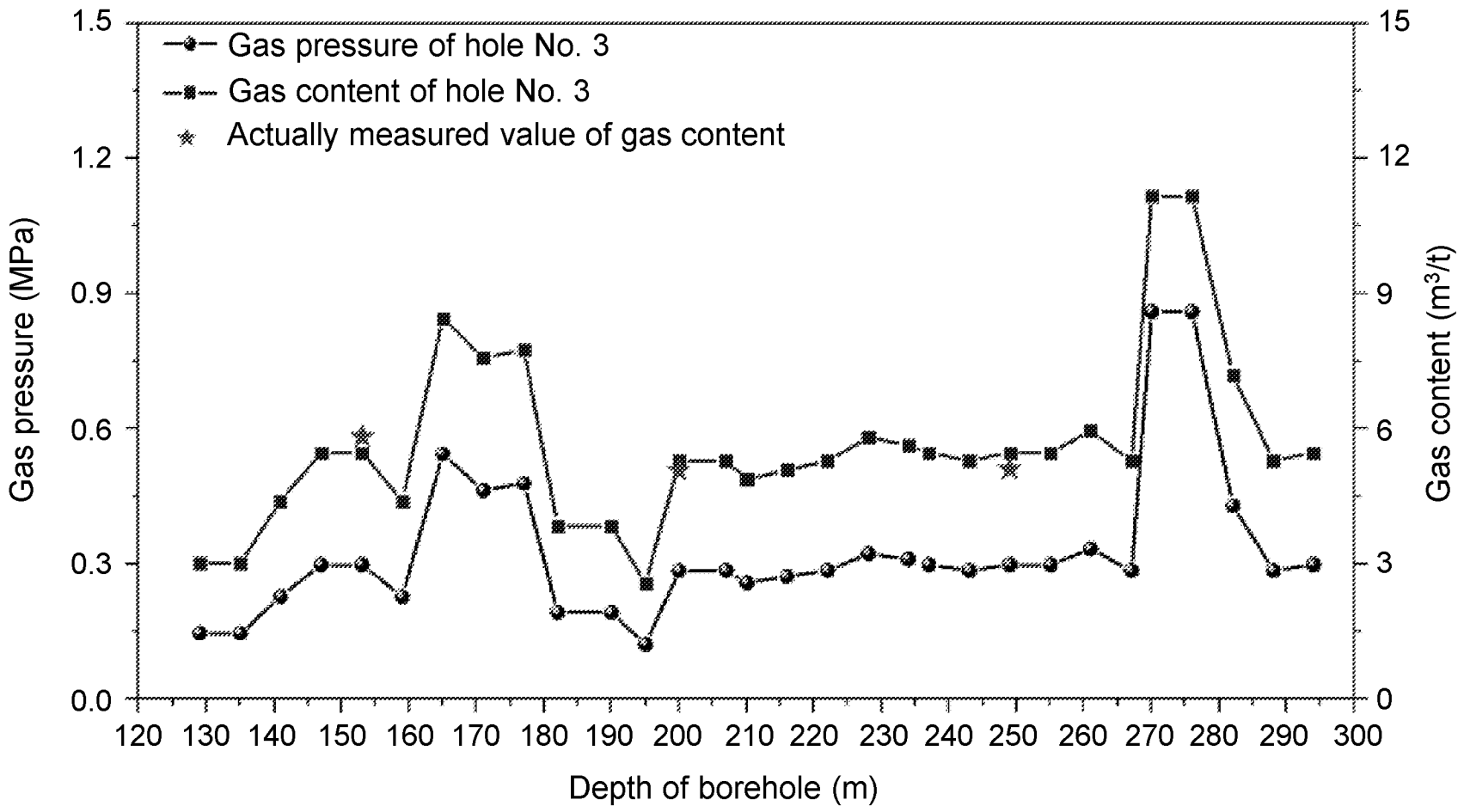
FIG. 2 is a schematic diagram of distribution and change of coal-bed gas parameters in a lengthwise direction of a borehole and a comparison result with an actually measured value of a coal-bed gas content according to an embodiment of the present invention.
Figure 3:
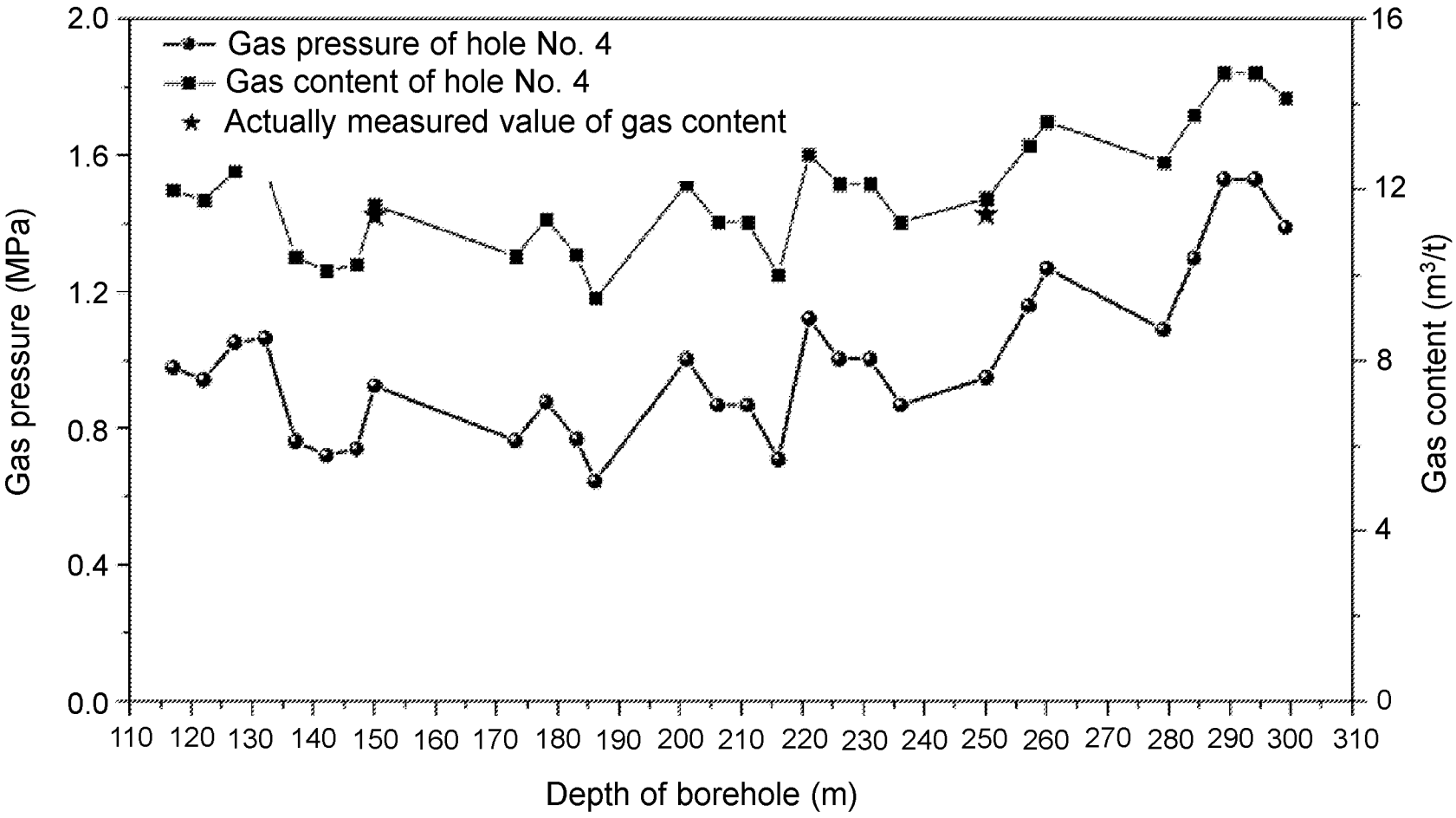
FIG. 3 is a schematic diagram of distribution and change of coal-bed gas parameters in a lengthwise direction of a borehole and a comparison result with an actually measured value of a coal-bed gas content according to an embodiment of the present invention.

Directional drilling is performed in an air way drilling field of a certain coal and gas outburst mine 12171. The drilling arrangement is shown in FIG. 1. The ZDY120000LD type crawler full-hydraulic tunnel drilling machine for a coal mine is used for drilling. Before drilling, a blowout prevention device is mounted at an orifice section, and a CGWZ-100 (C) pipeline laser comprehensive gas parameter tester and a drainage pipeline connected with the drainage system is connected to an extraction opening of the blowout prevention device. During the drilling, the coal appearing time and position are recorded. The CGWZ-100 (C) pipeline laser comprehensive gas parameter tester automatically records the gas flow and the gas concentration. The real-time drilling gas discharge amount and the average drilling gas discharge amount are calculated. The formulated ground monitoring and analysis software automatically calculates the coal-bed gas pressures and the coal-bed gas contents of the test sections of a borehole No. 3 and a borehole No. 4 at the hole depth of 100 m to 300 m according to the input drilling parameters, the coal-bed permeability, and the average drilling gas flow. The coal-bed gas contents reflect the distribution and changes of the coal-bed gas parameters in the lengthwise direction of the boreholes, and are compared with an actually measured value of the coal-bed gas content, as shown in FIG. 2 and FIG. 3. According to data comparison results, a difference between the coal-bed gas content tested while-drilling and the actually measured coal-bed gas content is 1.3% to 4.13%, which is less than 5%, and may fully meet the actual application needs on site. Under normal circumstances, a region with the coal-bed gas content that is greater than 8 $m^3/t$ or the gas pressure that is greater than 0.74 MPa is a coal-bed outburst danger region.

The technical features of the present invention that are not described may be implemented by using the existing technology, and are not described herein again. Certainly, the foregoing descriptions are not intended to limit the present invention, and the present invention is not limited to the foregoing examples. Changes, modifications, additions or replacements made by a person of ordinary skill in the art within the essential scope of the present invention shall fall within the protection scope of the present invention.

What is claimed is:

1. An inversion calculation method of coal-bed gas parameters of fast test while-drilling, comprising: during drilling in a coal bed, testing a gas flow and a gas concentration of an orifice in real time while-drilling, calculating a real-time drilling gas discharge amount and an average drilling gas discharge amount of the orifice, inversely calculating a coal-bed gas pressure at a drill bit based on borehole and coal-bed permeability parameters, and calculating a coal-bed gas content according to a gas content and gas pressure relational expression.

2. The inversion calculation method of coal-bed gas parameters of fast test while-drilling according to claim 1, wherein the inversion calculation method specifically comprises the following steps:

a. during drilling of a coal-bed borehole or a coal-passing borehole, mounting a blowout prevention device or an orifice quick sealing device at an orifice section, and connecting a comprehensive gas parameter tester and a drainage pipeline connected with a drainage system to an extraction opening of the blowout prevention device or the orifice quick sealing device;

b. connecting the drill bit to a drill rod, and starting to drill after the drill bit passes through the blowout prevention device or the orifice quick sealing device;

c. during drilling of the coal bed, recording a coal appearing time and position, automatically recording the gas flow and the gas concentration by the comprehensive gas parameter tester, and calculating the real-time drilling gas discharge amount and the average drilling gas discharge amount;

d. during drilling of the boreholes, automatically calculating a coal-bed gas pressure of a test section by formulated ground monitoring and analysis software according to input drilling parameters, the coal-bed permeability, and an average drilling gas flow, and calculating the coal-bed gas content according to a coal adsorption constant and environmental parameters;

e. during drilling of a main borehole and branch boreholes by a directional drilling machine, automatically calculating the coal-bed gas pressure of the test section by the formulated ground monitoring and analysis software according to the input drilling parameters, an exposure time of each coal section, the coal-bed permeability, and the average drilling gas discharge amount, and calculating the coal-bed gas content according to the coal adsorption constant and the environmental parameters;

f. predicting an outburst risk of each section of the coal bed according to parameters of the coal-bed gas pressure and the coal-bed gas content of each section; and g. in the process of drilling the coal-bed borehole or after the drilling ends, stopping drilling, closing a slag outlet, automatically recording a gas flow and a gas concentration within each time period by the comprehensive gas parameter tester, and calculating a natural gas discharge velocity of the borehole by the foiiiiulated ground monitoring and analysis software, automatically calculating a penetrability coefficient and a permeability of the coal bed at the section, and correcting the calculated coal-bed gas content or pressure parameter.

3. The inversion calculation method of coal-bed gas parameters of fast test while-drilling according to claim 2, wherein the inversion calculation method of the coal-bed gas pressure specifically comprises: in a drilling process of the drilling machine, recording in real time the gas flow and the gas concentration of the orifice and the real-time drilling gas discharge amount in the drilling process by the comprehensive gas parameter tester at the orifice, calculating the average drilling gas discharge amount, and inverting gas feature parameters of different positions of the coal bed according to the average drilling gas discharge amount, wherein a total amount of gas drained by the gas drainage system at the orifice is composed of three portions, comprising a gas amount released from a borehole wall newly formed in the coal-bed drilling process of the drilling machine, a gas amount released by drilling cuttings peeled off from the borehole wall, and a gas amount released from the borehole wall before a new borehole wall is formed; and the coal-bed gas pressure at the drill bit in the drilling process is:

$$pi = \sqrt{\frac{Q_{total} - V_{drill\ bit}\Delta t S_{section}\gamma\int_0^{\frac{l_{rock}+l_{coal}}{v}} Q_0 e^{-B_1 t}dt - \sum_1^{n-1}\int_0^{V_{drill\ bit}\Delta t}\int_{t_{i-1}}^{t_n} q_i e^{-B_2 t}dtdl}{-\frac{k}{2\mu p_n}\int_0^{V_{drill\ bit}\Delta t}\int_{t_{i-1}}^{t_n} e^{-B_2 t}dtdl}}, \quad (1)$$

wherein pi is the coal-bed gas pressure of a calculation point; $Q_{total}$ is the total gas discharge amount measured in a calculation section; $t_0$ is the first coal appearing time; $t_1, t_2, \ldots, t_n$ are selected time points for calculating the coal-bed gas parameters, $\Delta t = t_n - t_{n-1}$; $Q_0$ is a drilling cutting gas discharge intensity at an initial exposure moment, $m^3/t\cdot min$; $\beta_1$ is a drilling cutting gas attenuation coefficient, $min^{-1}$; v is a water flow velocity, m/s; $V_{drillbit}$ is a borehole drilling speed, m/s; $l_{rock}$ and $l_{cool}$ are a length of a formed rock borehole and a length of a formed coal-bed borehole, m; $S_{section}$ is a cross-sectional area of the borehole, $m^2$; $\gamma$ is a coal bulk density, $kg/m^3$; $q_i$ is a gas discharge amount on a coal wall per unit area, $m^3/m^2\cdot min$; $\beta_2$ is a borewall gas attenuation coefficient, $min^{-1}$; k is the coal-bed permeability, $m^2$; $\mu$ is a dynamic viscosity coefficient of gas, Pa·s; $p_n$ is an absolute pressure of gas drainage Pa; $R_M$ is an effective influence radius around the borehole, m.

4. The inversion calculation method of coal-bed gas parameters of fast test while-drilling according to claim 3, wherein to calculate a gas pressure of an $i^{th}$coal hole section, gas pressures of the previous (i−1) coal hole sections are calculated at first; since the gas pressure of each branch hole is different, $q_i$ is also different; the gas pressure of any coal hole section be calculated according to the above formula (1), and $q_i$ is calculated according to the formula:

$$q = -\frac{k}{2\mu p_n}\frac{\partial p^2}{\partial x}; \quad (2)$$

the drilling cutting gas attenuation coefficient $\beta_1$ and the borehole wall gas attenuation coefficient $\beta_2$ may be measured by experiments and field tests; and the coal-bed gas content $X_{mi}$ may be calculated through the gas content and gas pressure relational expression according to a coal-bed gas adsorption constant and the environmental parameters.

5. The inversion calculation method of coal-bed gas parameters of fast test while-drilling according to claim 1, wherein the gas flow and the gas concentration of the orifice of the borehole are tested in real time while-drilling; a real-time gas discharge amount of the orifice of the borehole is calculated by a comprehensive gas parameter tester and a drainage system, and then the average drilling gas discharge amount is calculated; and a time interval is time corresponding to a borehole drilling distance of 2 to 5 m.

6. The inversion calculation method of coal-bed gas parameters of fast test while-drilling according to claim 3, wherein in the step d and the step e, corresponding actually measured coal-bed permeability parameters are used for different drilling operations; and when no actually measured coal-bed permeability value is present, an original coal bed may use an original coal-bed permeability value of a coal bed in this region.

* * * * *